United States Patent [19]

Denizman

[11] 4,129,942

[45] Dec. 19, 1978

[54] SHAVING IMPLEMENT

[76] Inventor: Nejat H. Denizman, 676 W. Diversey Ave., Chicago, Ill. 60614

[21] Appl. No.: 832,586

[22] Filed: Sep. 12, 1977

[51] Int. Cl.[2] ..... B26B 21/44

[52] U.S. Cl. ..... 30/41

[58] Field of Search ..... 30/41, 62, 77; 132/80 R

[56] References Cited

U.S. PATENT DOCUMENTS

| | | | |
|---|---|---|---|
| 1,673,590 | 6/1928 | Redheffer | 30/41 |
| 1,899,841 | 2/1933 | Acken | 30/41 |
| 2,387,765 | 10/1945 | Monnet | 30/77 X |
| 2,632,446 | 3/1953 | Rosenzweig | 30/41 X |
| 2,669,017 | 2/1954 | Seko | 30/41 X |
| 2,818,872 | 1/1958 | Wang | 30/41 X |
| 3,176,391 | 4/1965 | Resnick | 30/41 |

*Primary Examiner*—Jimmy C. Peters

*Attorney, Agent, or Firm*—Wegner, Stellman, McCord, Wiles & Wood

[57] ABSTRACT

A shaving implement defining a shaving head and a handle having an end portion carrying the shaving head for manipulation of the implement in a normal shaving razor manner. The handle further defines at least one chamber for holding dispensable shaving-associated, or grooming, material, such as shaving cream, aftershave lotion, pre-shave lotion deodorant, etc. Structure is provided for retaining the shaving-associated material removably within the handle of the implement. The shaving-associated material may be retained directly in a chamber defined by the handle or may be retained in a container removably received within the handle. A removable handle portion defining a second chamber for holding such shaving-associated material may further serve as a closure for a chamber in a first portion of the handle arranged to receive a different shaving-associated material.

22 Claims, 6 Drawing Figures

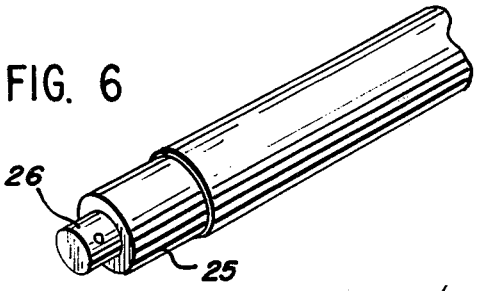
FIG. 6
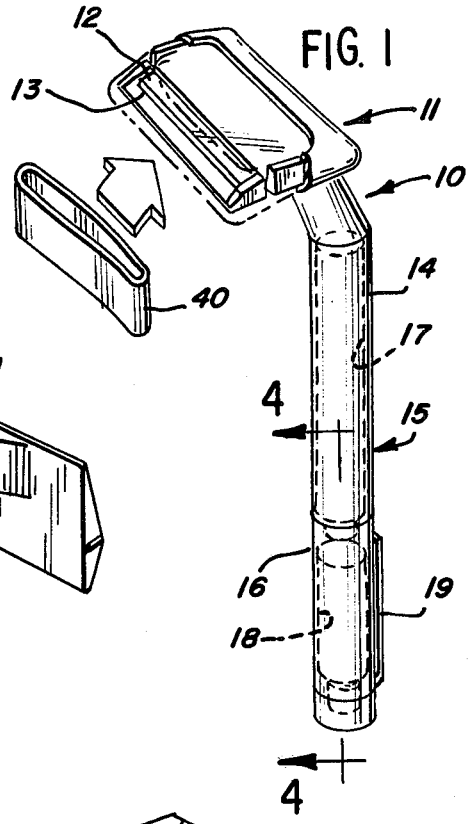
FIG. 1
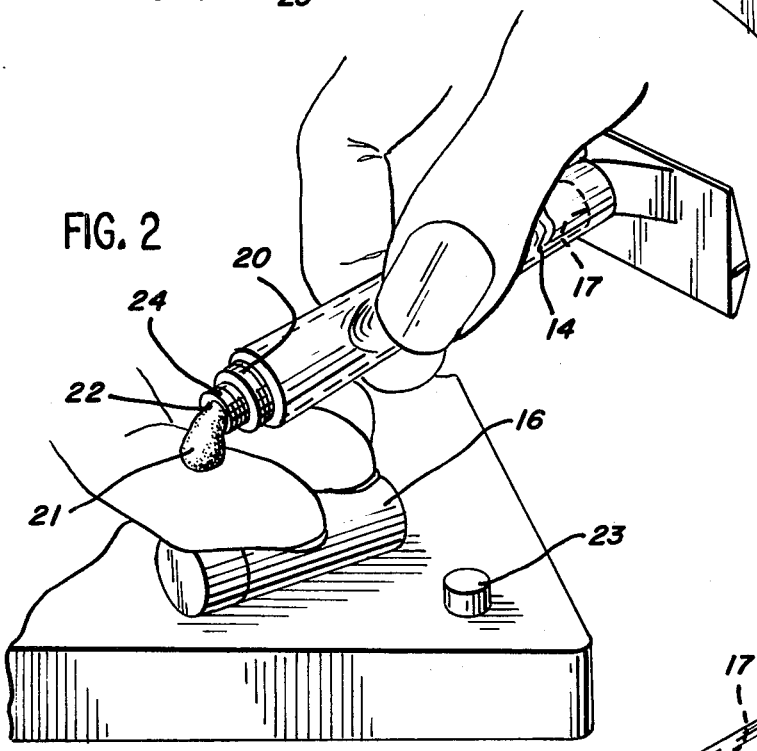
FIG. 2
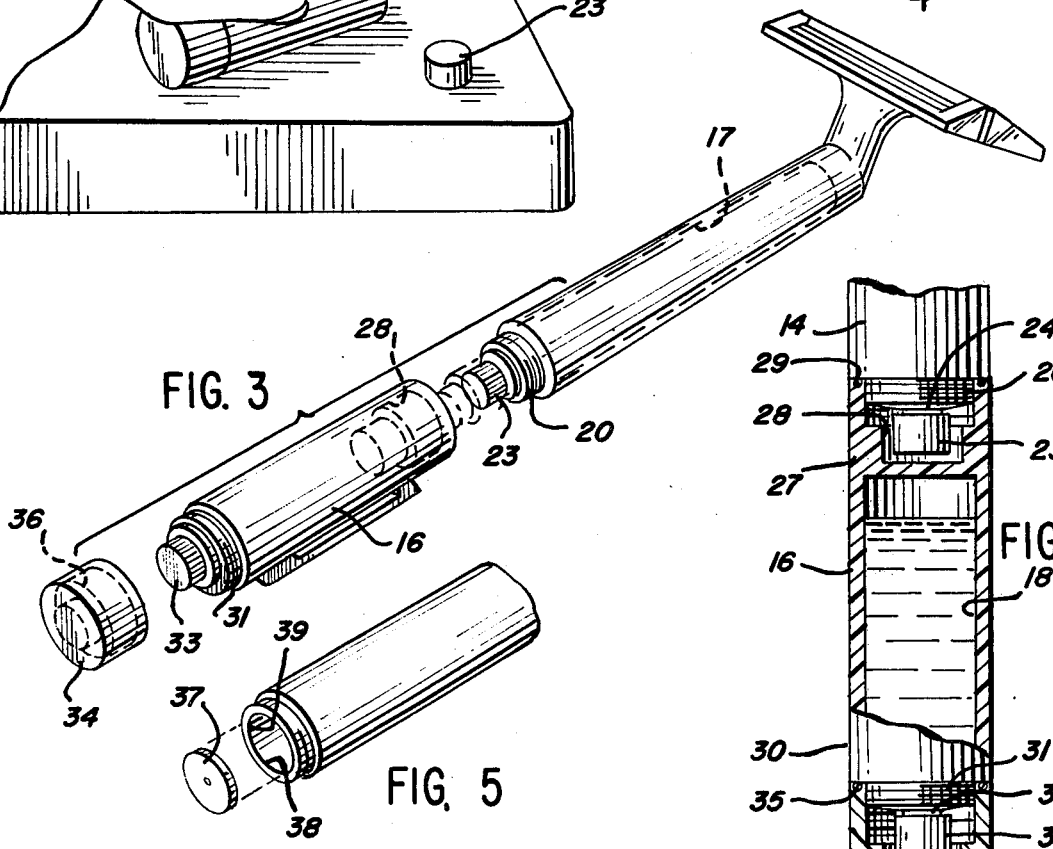
FIG. 3
FIG. 5
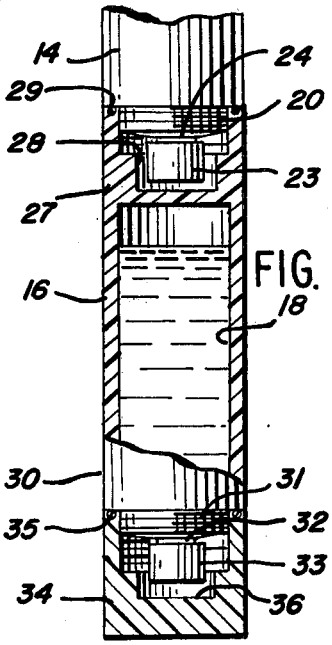
FIG. 4

SHAVING IMPLEMENT

BACKGROUND OF THE INVENTION

1. Field of the Invention

This invention relates to shaving implements, and in particular to hand razors.

2. Description of the Prior Art

In the conventional hand razor, a razor blade is mounted in a shaving head portion of the razor which is carried on the end of a handle normally grasped by the shaver during the shaving operation. In effecting a shaving operation, the user conventionally applies material, such as lather-forming material, to his face or body portion to be shaved. Conventionally, such lather may be obtained from a shaving mug and brush supply, lather-forming machines producing either cold or hot lather, a tube of lather-forming cream, aerosol cans of lather-forming cream, etc.

Other shaving-associated materials include pre-shave lotions intended to treat the hair for improved shaving action.

It is further conventional to use other shaving-associated materials, such as aftershave lotion upon completion of the shaving operation.

It has been conventional to provide such shaving-associated materials in separate containers for use by the shaver as desired. Such containers are conventionally stored with the razor in a suitable storage space, such as a medicine cabinet or bathroom drawer, etc., for independent selective use.

SUMMARY OF THE INVENTION

The present invention comprehends an improved shaving implement wherein one or more shaving-associated materials is stored integrally with the razor.

More specifically, the invention comprehends providing a shaving razor wherein one or more shaving-associated materials is stored within the handle of the razor.

In the illustrated embodiment, the handle defines one or more compartments selectively receiving one or more different shaving-associated materials, such as lather-forming materials, aftershave materials, pre-shave materials, etc.

The shaving-associated materials may be stored directly in chambers formed integrally in the handle or may be provided in separate containers removably installed in the handle.

Where the materials are stored directly in chambers formed in the handle, closure means may be provided for selectively retaining the material in the respective chambers.

In one form of the invention, the handle includes an end portion attached to the shaving head and an extension portion removably secured to the end portion. The end portion defines a first chamber for receiving one of the shaving-associated materials and the extension defines a second chamber for receiving a second one of the shaving-associated materials.

The extension may define a closure for the chamber of the end portion of the handle.

The handle may define a constrictible means for selective constriction by the user in dispensing the shaving-associated material.

In one form, the handle is relatively rigid with the material being retained in a ccontainer, such as a conventional squeeze tube, or an aerosol container having a dispensing mechanism permitting the user to dispense the shaving-associated material by suitable manipulation of the aerosol dispensing mechanism.

In one form, the shaving-associated material comprises a liquid material and the shaving implement may be provided with a perforate closure element for controlling the rate of delivery of the liquid material during the dispensing operation.

In one form, the retaining means may comprise a threadedly attached closure cap.

The chambers may be arranged to be pre-charged in the manufacture and sale of the shaving implement, or may be arranged to permit the user to provide or replace the shaving-associated materials as desired.

A protective cover may be provided for enclosing the shaving head to permit the user to carry the shaving implement on his person without injury from the blade of the shaving head. Thus, the shaving implement is adapted for portable use as it may be safely carried in the pocket or pocketbook of the user as well as utilized in the normal manner wherein the implement is maintained in a residential bathroom or the like.

The shaving implement of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a shaving implement embodying the invention and illustrating the mounting of a protective razor edge covering device to the shaving head;

FIG. 2 is a perspective view illustrating the use of the implement in obtaining lather-forming shaving-associated material from the handle portion thereof;

FIG. 3 is an exploded perspective view illustrating the association of the handle portions forming the respective shaving-associated material chambers therein;

FIG. 4 is a fragmentary enlarged diametric section thereof;

FIG. 5 is a fragmentary perspective view illustrating a modified form of material holding means for use therein; and FIG. 6 is a fragmentary perspective view illustrating the use of a separate container for carrying the shaving-associated material within a chamber of the handle in a further modified form of the invention.

DESCRIPTION OF THE PREFERRED EMBODIMENTS

In the illustrative embodiments of the invention as shown in the drawing, a shaving implement generally designated 10 is shown to comprise a hand razor having a conventional shaving head 11 adapted to removably receive any one of a plurality of razor blades 12 defining a sharp shaving edge 13. Alternatively, the shaving head may be provided with a permanently associated blade. The shaving head is connected to an end portion 14 of a handle 15 permitting the shaving implement to be utilized as a conventional hand-held safety razor.

The invention comprehends providing in handle 15 one or more chambers for use in storing shaving-associated materials, such as lather-producing materials, pre-shave lotions, after-shave lotions, etc. In the illustrated embodiment, handle 15 includes an extension portion 16. End portion 14 may define a first chamber 17 for holding a first shaving-associated material, such as lather-forming material, and extension 16 may define a second chamber 18 for holding a different shaving-associated material, such as aftershave lotion.

Extension 16 is arranged to be removably secured to handle portion 14 and may be provided with a suitable spring clip 19 such as for securing the shaving implement to the edge of a user's pocket or the like in the manner of a conventional fountain pen, etc.

In the illustrated embodiment as shown in FIG. 2, extension portion 16 of the handle is threadedly secured to a threaded connecting portion 20 of the handle portion 14. As illustrated in FIG. 2, handle portion 14 may be constrictable so as to permit the user to dispense the shaving-associated material, such as lather-forming material 21, through a suitable opening 22 in the threaded connecting portion 20 as the result of a constriction of the handle portion 14 by the user's fingers. Such dispensing may be effected by firstly removing the extension portion 16 which serves as a closure, or cap, for the chamber 17 within the handle portion 14. Alternatively, as shown in FIG. 2, a separate removable cap 23 may be secured to a reduced diameter threaded portion 24 of the connector 20, as desired.

As indicated briefly above, the shaving-associated material 21 may be retained directly in the chamber 17 or chamber 18 such as in the manner shown in FIG. 2. However, as further indicated above, the material may be alternatively retained in a separate container, such as container 25 illustrated in FIG. 6, which may comprise an aerosol container having a suitable pressurized fluid retained therein with the sahving material so as to be selectively dispensed through a conventional aerosol dispensing mechanism 26. The container 25 may be removably received in the chamber 17 or chamber 18 and, thus, may be replaced upon exhaustion of the contents thereof as desired.

As shown in FIG. 4, the end 27 of extension 16 threaded to the connector 20 may define a recess 28 freely receiving the cap 23 carried on the connector portion 24. A suitable gasket 29 may be provided for sealing the extension portion 27 to the handle portion 14, as desired.

As further shown in FIG. 4, distal end 30 of extension 16 may be provided with a connector portion 31 having a reduced diameter portion 32. A cap 33 may be provided for retaining the material in chamber 18. Further, an outer closure cap 34 may be threaded to the connector portion 31 and sealed to the extension portion 30 by a suitable gasket 35. Closure 34 may define a recess 36 similar to recess 28 for freely receiving the cap 33 carried on the connector 31.

Referring now more specifically to FIG. 5, a modified form of retaining means may be provided to include a perforated disc 37 retained in the outlet opening 38 from the material-holding chamber so as to permit control of the delivery of the material as where the material comprises a liquid material. Disc 37 may be retained within the outlet 38 on a suitable annular flange 39 formed therein, as desired.

The shaving-associated materials may be provided in any suitable form, such as foam, liquid, gel, powder, etc. As indicated briefly above, the materials may be provided in the chambers of the handle as marketed or may be added to the chambers by the user, as desired. The latter method permits the user to provide materials of his own selection.

As indicated above, the replenishment of the materials may be effected alternatively by provision of such materials in cartridge or aerosol container form, as well as by direct insertion of the materials from larger supplies of the user.

In lieu of the protective cover 40 discussed briefly above for protecting the user against inadvertent contact with the sharp edge of the razor blade carried by the shaving head, the user may carry the implement with the blade removed, as desired.

In one form of the improved shaving implement, the implement had an overall length of approximately 6½ inches. The handle portion had a maximum outside diameter of approximately 9/16 inch.

In the illustrated embodiment, chamber 17 may have a length greater than that of chamber 18 so as to permit the storage of a larger quantity of material therein. Where separate containers are utilized for holding the material in the respective chambers, the containers may be suitably sized for reception in the respectively different size chambers as desired.

Handle portion 14 and extension 16 may be formed selectively of any suitable constrictible or rigid material as desired. In the illustrated embodiment, the handle 14 and extension 16 are formed of a suitable molded synthetic resin whereby the shaving implement may be formed at relatively low cost. Thus, the shaving implement may alternatively be arranged for a single non-refillable utilization wherein the amount of shaving-associated material is coordinated with the expected life of the razor blade provided therewith so that the entire sahving implement may comprise a throwaway implement having a normal life, such as of approximately 2 weeks or 15 shaves. Thus, the shaving implement would be ideal for vacationers or traveling business persons.

The shaving implement is intended for use not only by men but also by women as for use in shaving their legs and underarms. Thus, wherever the user is referred to herein, it is intended that the user be considered as either male or female.

The foregoing disclosure of specific embodiments is illustrative of the broad inventive concepts comprehended by the invention.

I claim:

1. In a shaving implement having means defining a shaving head, the improvement comprising a handle having a first portion carrying said shaving head suitably to permit the implement to be used as a manually operable razor, said handle first portion defining a chamber removably holding dispensable shaving-associated material, said handle further including an extension portion removably secured to said first portion and defining a second chamber removably holding a different shaving-associated material, said extension portion further defining means for selectively retaining the shaving-associated material in said first chamber to permit selective dispensing thereof as desired.

2. The shaving implement of claim 1 wherein said shaving-associated material in said first chamber comprises lather-forming material.

3. The shaving implement of claim 1 wherein said shaving-associated material in said second chamber comprises pre-shaving material.

4. The shaving implement of claim 1 wherein said shaving-associated material in said second chamber comprises aftershave lotion material.

5. The shaving implement of claim 1 wherein at least one of said handle portions is constrictible and arranged to dispense said dispensable shaving-associated material from the chamber thereof as an incident of constriction thereof.

6. The shaving implement of claim 1 wherein at least one of the shaving-associated materials is carried in a housing removably received in its chamber.

7. The shaving implement of claim 1 wherein at least one of the shaving-associated materials is carried in a housing removably received in its chamber and provided with a dispensing mechanism for dispensing the material from the housing as an incident of manipulation of the dispensing mechanism.

8. The shaving implement of claim 1 wherein at least one of the shaving-associated materials is carried in a housing removably received in its chamber and provided with a dispensing mechanism for dispensing the material from the housing as an incident of manipulation of the dispensing mechanism with the housing being retained within said chamber and said mechanism projecting outwardly therefrom.

9. The shaving implement of claim 1 wherein a blade edge cover guard is removably mounted to the shaving head.

10. The shaving implement of claim 1 wherein said extension portion is threadedly secured to the distal end of said end portion and defines a closure cap selectively closing said first chamber of said end portion.

11. The shaving implement of claim 1 wherein at least one of said chambers is provided with a removable container housing the shaving-associated material therein.

12. The shaving implement of claim 1 wherein at least one of said chambers is provided with a removable container housing the shaving-associated material therein and provided with pressurized dispensing fluid and a dispensing mechanism for dispensing the shaving-associated material from the container as an incident of manipulation of the dispensing mechanism.

13. The shaving implement of claim 1 wherein said chamber is provided with deodorant material.

14. In a shaving implement having means defining a shaving head, the improvement comprising:

a composite handle having a first portion carrying said shaving head suitably to permit the implement to be used as a manually operable razor and defining a first chamber, said handle further including an extension portion removably secured to said first portion and defining a second chamber, said first and second chambers holding respectively different dispensable shaving-associated materials;

first retaining means for removably retaining the shaving-associated materials in said first chamber; and second retaining means for removably retaining the shaving-associated material in said second chamber thereby to permit selective individual dispensing of said materials therefrom as desired, access to said first retaining means being prevented as a result of said extension being secured to said first portion.

15. The shaving implement of claim 14 wherein at least one of said first portion and said extension portion being constrictable and arranged to dispense the dispensable shaving-associated material from the chamber thereof as an incident of constriction thereof.

16. The shaving implement of claim 14 wherein said extension portion is threadedly secured to the distal end of said first portion.

17. The shaving implement of claim 14 wherein a disposable cartridge containing shaving-associated material is removably installed in said first chamber.

18. The shaving implement of claim 14 wherein a disposable cartridge containing shaving-associated material is removably installed in at least one of said chambers, said cartridge being provided with the means for retaining said shaving-associated material in the chamber to permit selective dispensing of said material therefrom as desired.

19. The shaving implement of claim 14 wherein said means for retaining said shaving-associated material in said second chamber to permit selective dispensing of said material therefrom as desired comprises a closure removably threaded to said extension portion for selectively closing said second chamber.

20. The shaving implement of claim 14 wherein one of said handle portions is provided with a spring clip.

21. The shaving implement of claim 14 wherein at least one of said shaving-associated materials is a liquid.

22. The shaving implement of claim 14 wherein at least one of said shaving-associated materials is a liquid and the retaining means associated therewith includes a perforated closure element arranged to control the rate of delivery of the liquid from the chamber during a dispensing operation.

* * * * *